US011713882B2

(12) United States Patent
Prior et al.

(10) Patent No.: US 11,713,882 B2
(45) Date of Patent: Aug. 1, 2023

(54) FIREPLACE CONSTRUCTION

(71) Applicant: Meredith Group, LLC, Richmond, IN (US)

(72) Inventors: Christopher C. Prior, Middle Grove, NY (US); John E. Meredith, Richmond, IN (US)

(73) Assignee: Meredith Group, LLC, Richmond, IN (US)

( * ) Notice: Subject to any disclaimer, the term of this patent is extended or adjusted under 35 U.S.C. 154(b) by 240 days.

(21) Appl. No.: 17/201,095

(22) Filed: Mar. 15, 2021

(65) Prior Publication Data

US 2021/0285647 A1 Sep. 16, 2021

Related U.S. Application Data

(60) Provisional application No. 63/160,106, filed on Mar. 12, 2021, provisional application No. 62/989,049, filed on Mar. 13, 2020.

(51) Int. Cl.

| | |
|---|---|
| ***F24B 1/19*** | (2006.01) |
| ***F24B 1/195*** | (2006.01) |
| ***F24B 1/197*** | (2006.01) |

(52) U.S. Cl.

CPC ..... *F24B 1/1902* (2013.01); *F24B 1/197* (2013.01); *F24B 1/1957* (2013.01)

(58) Field of Classification Search

CPC ..... F24B 1/1902; F24B 1/1957

See application file for complete search history.

(56) References Cited

U.S. PATENT DOCUMENTS

| | | | | | |
|---|---|---|---|---|---|
| 1,987,252 | A * | 1/1935 | Cage | F24B 1/1885 | 126/531 |
| 2,117,379 | A * | 5/1938 | Turner | F24B 1/1885 | 126/524 |
| 2,275,493 | A * | 3/1942 | Ry | F24B 1/1895 | 126/536 |
| 2,360,611 | A * | 10/1944 | Josephe | F24C 1/14 | 126/90 R |
| 2,752,691 | A * | 7/1956 | Bender | E04G 9/083 | 52/749.15 |
| 2,808,824 | A * | 10/1957 | Cage | F24B 1/1895 | 126/510 |
| 3,094,114 | A * | 6/1963 | Cage | F23L 17/00 | 74/547 |
| 3,301,249 | A * | 1/1967 | Hendricks | F24B 1/18 | 249/91 |
| 3,466,000 | A * | 9/1969 | Scholz | E04F 19/005 | 126/500 |
| 3,976,048 | A * | 8/1976 | Ashman, Jr. | F24B 1/19 | 126/518 |

(Continued)

*Primary Examiner* — David J Laux

(74) *Attorney, Agent, or Firm* — Woodard, Emhardt, Henry, Reeves & Wagner, LLP

(57) ABSTRACT

A fireplace construction made of solid masonry units having a rear wall with a symmetrical bulge formed by a lower angled portion, a central vertical portion, an upper angled portion, and an upper vertical portion. Each portion is slightly spaced apart from the adjacent portion to provide a space for air to flow into the firebox. One or more air ducts route air from the room to the space between both the lower vertical portion and the lower angled portion and the space between the lower angled portion and the central vertical portion.

12 Claims, 14 Drawing Sheets

(56) References Cited

U.S. PATENT DOCUMENTS 4,059,090 A * 11/1977 Shaw ..... F24B 1/1885 126/517
4,182,306 A * 1/1980 Tomich ..... F24B 1/1886 165/909
4,196,715 A * 4/1980 Shaw ..... F24B 1/1886 126/517
4,223,833 A * 9/1980 Ebbers ..... F24B 1/1902 126/525
4,230,268 A * 10/1980 Gorman ..... F24B 1/1802 126/509
4,542,736 A * 9/1985 Scheier ..... F24B 1/192 126/545
4,635,616 A * 1/1987 Jones ..... F24B 1/1895 126/285 R
4,928,667 A * 5/1990 Shaw ..... F24B 1/1808 126/110 E
4,964,396 A * 10/1990 Crum ..... F24B 1/1885 126/517
4,964,921 A * 10/1990 Lloyd ..... F23J 3/026 15/301
5,282,459 A * 2/1994 Soule ..... F24B 1/192 126/552
6,286,502 B1 * 9/2001 Moberg ..... F24B 1/18 126/515
7,140,364 B1 * 11/2006 Buffington ..... F24B 1/18 126/500
8,622,054 B1 * 1/2014 Grace ..... F24B 1/1895 126/500
2008/0184988 A1 * 8/2008 Mullin ..... F24B 1/18 126/500
2010/0095952 A1 * 4/2010 Husted ..... E04F 13/0862 126/500
2011/0088683 A1 * 4/2011 Spadaro ..... F24B 1/195 126/500
2016/0245530 A1 * 8/2016 Marple ..... F23D 14/105

* cited by examiner

Clip shape details

Clip positioning and tab bend locations

Backwall plenum air induction clips

Course one clip

Course two clip

Course three clip

Course four clip

Course five clip

Course six clip

Course seven clip

Brick in position

Clip shape details

FIREPLACE CONSTRUCTION

CROSS-REFERENCE TO RELATED APPLICATIONS

This application claims the benefit of U.S. Provisional Patent Application No. 62/989,049, filed Mar. 13, 2020, and the benefit of U.S. Provisional Patent Application No. 63/160,106, filed Mar. 12, 2021; the entire contents of both applications being hereby incorporated herein by reference.

FIELD OF THE INVENTION

The present invention relates generally to fireplaces, and more particularly to a fireplace construction that can be built into a wall of a room, or can be provided as a kit to retrofit an existing fireplace.

BACKGROUND TO THE INVENTION

High quality fireplace constructions can reduce fuel requirements while providing more efficient heat transfer from the fire to the surrounding space. With many existing fireplace systems, heat transfer to the space immediately adjacent the fire is too great, and heat transfer to the space farther away from the fire is too low, with too much heat being lost up the chimney of the fireplace.

Homeowners may attempt to correct the deficiencies of their existing fireplace by removing and replacing the fireplace, or by installing a fireplace insert that is intended to improve performance. However, the cost to rebuild a fireplace is high, and the efficiency of many fireplace inserts is poor.

A need therefore exists for a fireplace construction option that can significantly improve fireplace efficiency as either as original construction or as a retrofit installation. The present invention addresses that need.

SUMMARY OF THE INVENTION

The present invention provides a fireplace construction comprising a firebox that may be installed in original construction or installed as a retrofit kit to improve fireplace performance. In both cases, the firebox preferably comprises:

a) a solid floor;

b) side walls extending upward from the floor to a flue;

c) a rear wall having:

i) a lower vertical portion, ii) a lower angled portion extending forward into the firebox and spaced slightly apart from the lower vertical portion to provide a space for air to flow into the firebox between the lower vertical portion and the lower angled portion, iii) a central vertical portion positioned forward of the plane of the lower vertical portion and spaced slightly apart from the lower angled portion to provide a space for air to flow into the firebox between the lower angled portion and the central vertical portion, iv) an upper angled portion extending rearward from the plane of the central vertical portion, and spaced slightly apart from the central vertical portion to provide a space for air to flow into the firebox between the central vertical portion and upper angled portion, and v) an upper vertical portion positioned rearward of the plane of the central vertical portion, and optionally spaced slightly apart from the upper central angled portion to optionally provide a space for air to flow into the firebox between the upper vertical portion and upper angled portion, wherein the lower central angled portion, the central vertical portion, and the upper central angled portion combine to form a smooth, symmetrical bulge in the back wall extending into the firebox;

d) one or more air ducts effective to route air from the room to the space between the lower vertical portion and the lower angled portion, and from the room to the space between the lower angled portion and the central vertical portion;

d) an open front; and e) an open top effective for directing air and combustion gasses from the firebox to a flue.

In a further embodiment the lower angled portion comprises a first lower angled portion and a second lower angled portion spaced slightly apart from the first lower angled portion to provide a space for air to flow into the firebox between the first lower angled portion and the second lower angled portion. In this embodiment the central vertical portion may comprise a first central vertical portion and a second central vertical portion spaced slightly apart from the first central vertical portion to provide a space for air to flow into the firebox between the first central vertical portion and the second central vertical portion, and wherein the fireplace construction includes one or more air ducts effective to route air from the room to the space between the first lower angled portion and the second lower angled portion. Further, the fireplace construction preferably includes one or more air ducts effective to route air from the room to the space between the first central vertical portion and the second central vertical portion.

In a further embodiment the construction further includes one or more air ducts effective to route air from the room to the space between the central vertical portion and the upper angled portion.

In a further embodiment the upper angled portion comprises a first upper angled portion and a second upper angled portion spaced slightly apart from the first upper angled portion to provide a space for air to flow into the firebox between the first upper angled portion and the second upper angled portion, and wherein the fireplace construction includes one or more air ducts effective to route air from the room to the space between the first upper angled portion and the second upper angled portion.

In a further embodiment the lower angled portion additionally comprises a third lower angled portion spaced slightly apart from the second lower angled portion to provide a space for air to flow into the firebox between the second lower angled portion and the third lower angled portion, and wherein the central vertical portion comprises a third central vertical portion spaced slightly apart from the second central vertical portion to provide a space for air to flow into the firebox between the second central vertical portion and the third central vertical portion, and wherein the fireplace construction includes one or more air ducts effective to route air from the room to the space between the second lower angled portion and the third lower angled portion, and wherein the fireplace construction includes one or more air ducts effective to route air from the room to the space between the second central vertical portion and the third central vertical portion.

In a further embodiment the upper angled portion comprises a third upper angled portion spaced slightly apart from the second upper angled portion to provide a space for air to flow into the firebox between the third upper angled portion and the second upper angled portion, and the fireplace construction includes one or more air ducts effective to route air from the room to the space between the third upper angled portion and the second upper angled portion.

In a further embodiment the rear wall comprises a plurality of bricks supported by a frame. Each of the plurality of bricks may be positioned on the frame using clips.

In a further embodiment one or more of the air ducts provided to route air from the room to the space between the lower vertical portion and the lower angled portion, and from the room to the space between the lower angled portion and the central vertical portion, includes a manifold effective to receive air from an opening below and forward of the firebox floor and to route air entering that manifold to the space between the lower vertical portion and the lower angled portion of the rear wall, and to the space between the lower angled portion and the central vertical portion of the rear wall.

WRITTEN DESCRIPTION OF THE PREFERRED EMBODIMENTS

For the purposes of promoting an understanding of the principles of the invention, reference will now be made to certain embodiments and specific language will be used to describe the same. It will nevertheless be understood that no limitation of the scope of the invention is thereby intended, with such alterations and modifications to the illustrated device being contemplated as would normally occur to one skilled in the art to which the invention relates.

Figure 15:
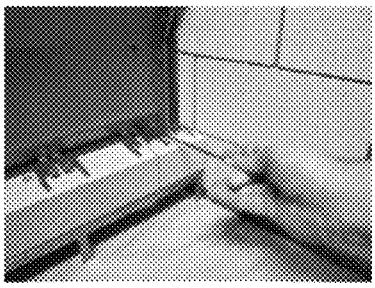
Figure 15:
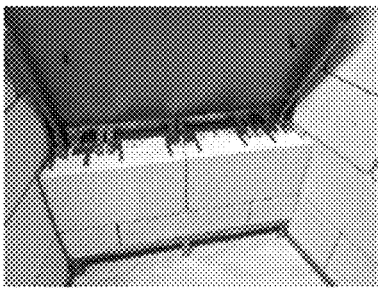
Figure 15:
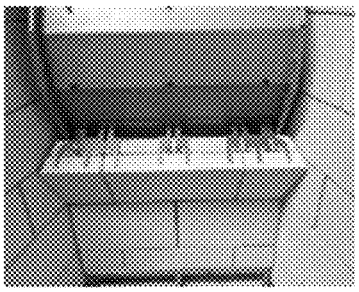
Figure 15:
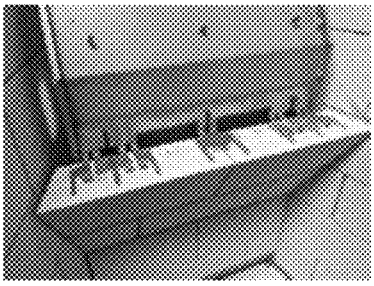
Figure 15:
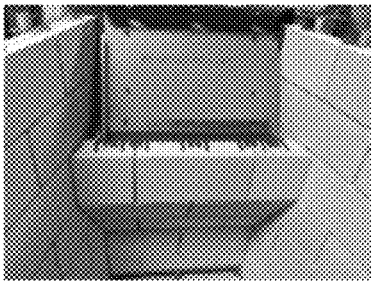
Figure 15:
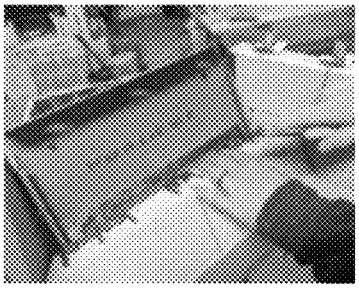
Figure 15:
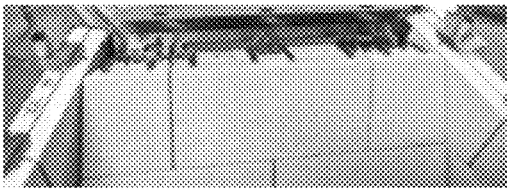
Figure 15:
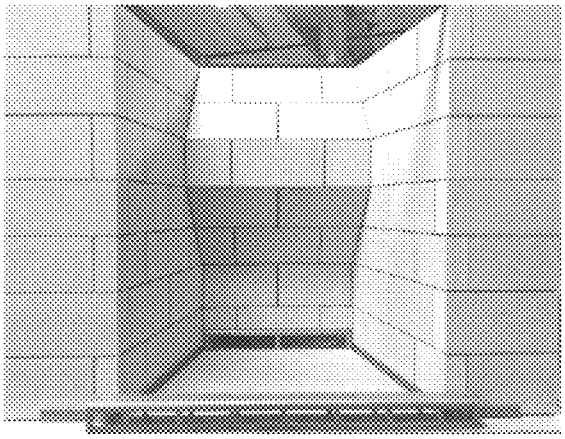
Figure 15:
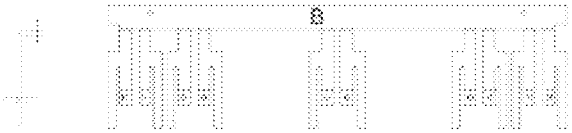

The anatomy of a standard fireplace, as described by the Chimney Safety Institute of America, is shown in FIG. 15, and includes a firebox, a hearth extending forward from the firebox, a flue, and a transitional smoke chamber connecting the firebox to the flue. For the purposes of this disclosure, the firebox will be described as connecting to the flue regardless of whether a transitional smoke chamber is included or identified.

As previously indicated, one aspect of the present invention provides a fireplace construction comprising a firebox. The firebox preferably comprises:

a) a solid floor;

b) side walls extending upward from the floor to a flue;

c) a rear wall having:

i) a lower vertical portion, ii) a lower angled portion spaced slightly apart from the lower vertical portion to provide a space for air to flow into the firebox between the lower vertical portion and the lower angled portion, iii) a central vertical portion spaced slightly apart from the lower angled portion to provide a space for air to flow into the firebox between the lower angled portion and the central vertical portion, iv) an upper angled portion spaced slightly apart from the central vertical portion to provide a space for air to flow into the firebox between the central vertical portion and upper angled portion, and v) an upper vertical portion, optionally spaced slightly apart from the upper central angled portion to optionally provide a space for air to flow into the firebox between the upper vertical portion and upper angled portion, wherein the lower central angled portion, the central vertical portion, and the upper central angled portion combine to form a smooth, symmetrical bulge in the back wall extending into the firebox;

d) one or more air ducts effective to route air from the room to the space between the lower vertical portion and the lower angled portion, and from the room to the space between the lower angled portion and the central vertical portion;

d) an open front; and e) an open top effective for directing air and combustion gasses from the firebox to a flue.

In a second embodiment the lower angled portion comprises a first lower angled portion and a second lower angled portion spaced slightly apart from the first lower angled portion to provide a space for air to flow into the firebox between the first lower angled portion and the second lower angled portion. In this embodiment the central vertical portion may comprise a first central vertical portion and a second central vertical portion spaced slightly apart from the first central vertical portion to provide a space for air to flow into the firebox between the first central vertical portion and the second central vertical portion, and wherein the fireplace construction includes one or more air ducts effective to route air from the room to the space between the first lower angled portion and the second lower angled portion. Further, the fireplace construction preferably includes one or more air ducts effective to route air from the room to the space between the first central vertical portion and the second central vertical portion.

In a third embodiment the construction further includes one or more air ducts effective to route air from the room to the space between the central vertical portion and the upper angled portion.

In a fourth embodiment the upper angled portion comprises a first upper angled portion and a second upper angled portion spaced slightly apart from the first upper angled portion to provide a space for air to flow into the firebox between the first upper angled portion and the second upper angled portion, and wherein the fireplace construction includes one or more air ducts effective to route air from the room to the space between the first upper angled portion and the second upper angled portion.

In a fifth embodiment the lower angled portion additionally comprises a third lower angled portion spaced slightly apart from the second lower angled portion to provide a space for air to flow into the firebox between the second lower angled portion and the third lower angled portion, and wherein the central vertical portion comprises a third central vertical portion spaced slightly apart from the second central vertical portion to provide a space for air to flow into the firebox between the second central vertical portion and the third central vertical portion, and wherein the fireplace construction includes one or more air ducts effective to route air from the room to the space between the second lower angled portion and the third lower angled portion, and wherein the fireplace construction includes one or more air ducts effective to route air from the room to the space between the second central vertical portion and the third central vertical portion.

In a sixth embodiment the upper angled portion comprises a third upper angled portion spaced slightly apart from the second upper angled portion to provide a space for air to flow into the firebox between the third upper angled portion and the second upper angled portion, and the fireplace construction includes one or more air ducts effective to route air from the room to the space between the third upper angled portion and the second upper angled portion.

In a seventh embodiment the rear wall comprises a plurality of bricks supported by a frame. Each of the plurality of bricks may be positioned on the frame using clips.

In a further embodiment one or more of the air ducts provided to route air from the room to the space between the lower vertical portion and the lower angled portion, and from the room to the space between the lower angled portion and the central vertical portion, includes a manifold effective to receive air from an opening below and forward of the firebox floor and to route air entering that manifold to the space between the lower vertical portion and the lower angled portion of the rear wall, and to the space between the lower angled portion and the central vertical portion of the rear wall.

The fireplace preferably has a solid floor on which fuel is placed so that combustion air does not flow to the fire from beneath the fuel. Instead, air flows to the fire from above the fuel after entering the fireplace through vents/openings in the walls of the fireplace above the fuel. That air then combusts or is heated by the fire before being exhausted up the chimney. The vents/openings in the fireplace wall are supplied with air through an air duct that opens to the room below the fireplace. Room air enters duct A and is drawn upward to duct B where it is drawn into the fireplace. The flow of room air through the duct below the fireplace helps cool the fireplace floor.

Figure 1:
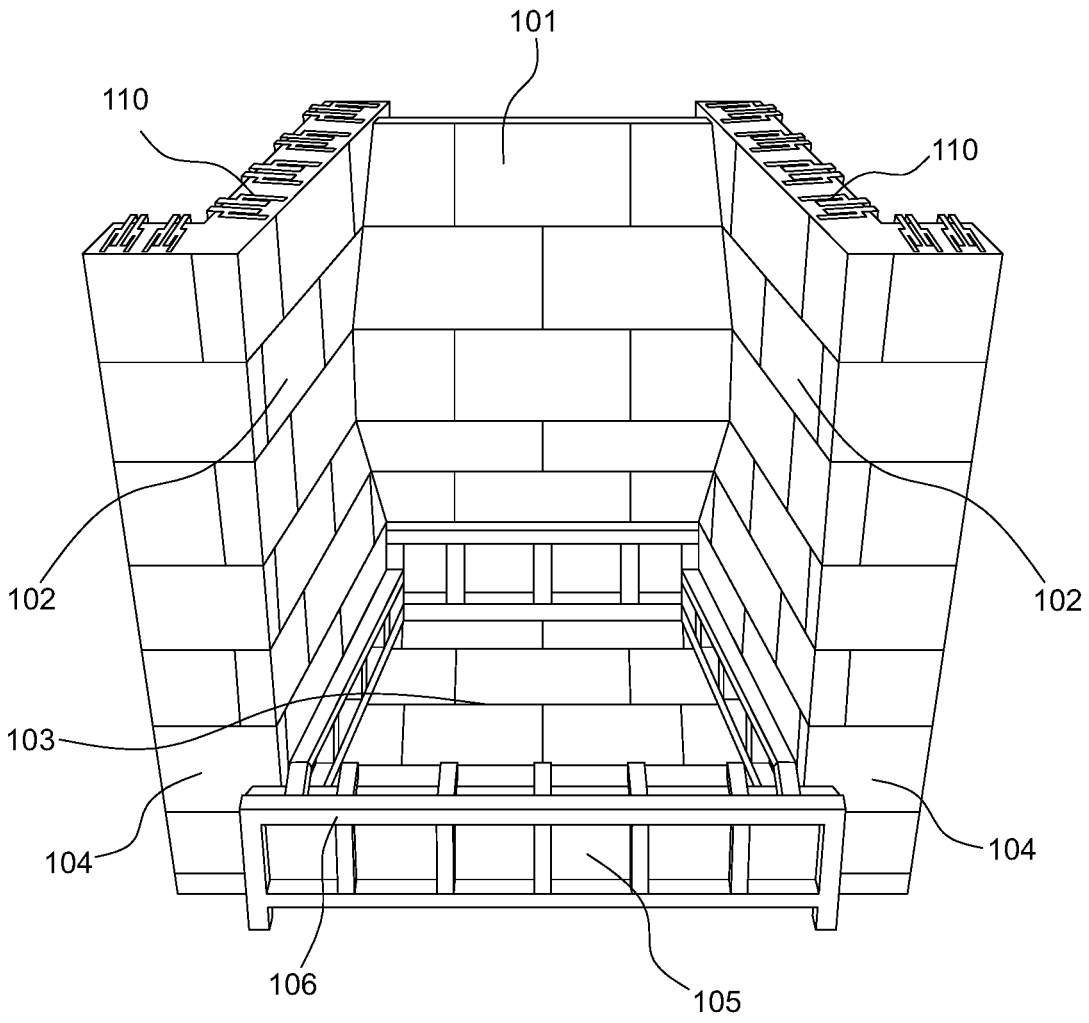
FIG. 1 is perspective view of one embodiment of the present invention, showing many of the basic features of the fireplace.

Referring now to the drawings, FIG. 1, which is a side sectional view, illustrates the basic air flow. The rear wall of the fireplace, in which the openings/vents are provided, has a specific shape, namely, a "bulging" shape as shown in the Figure below. This rear wall shape includes a solid lower portion, a lower central angled portion, a central vertical portion, an upper central angled portion, and an upper vertical portion. Openings/vents are provided in the lower angled portions and in the central vertical portion. In particular, the illustrated fireplace restoration retrofit system includes firebox backwall 101, firebox sidewalls 102, fireplace floor 103, front closure extensions 104, front radiation guard 105, grate assembly 106, and pip and clip fastening system 110.

FIG. 1 also shows an embodiment of the present invention comprising a Rosin-style, site-assembled fireplace restoration retrofit system kit designed to be a replacement firebox for an existing masonry fireplace. The illustrated embodiment features a low conductivity, highly insulative and reflective brick in the firebox construction. The bricks are assembled individually into a unique and purposeful geometrical shape. The design preferably has an integral grate with a radiation deflector panel. It may be assembled with a frame pipe and clip brick fastening system effective to simplify the construction and provide a more accurately dimensioned installation.

In one embodiment the rear of the assembly is insulated with ceramic paper or other high-temperature insulating material to help retard convective heat loss out the back of the unit.

The shape of the back wall forces smoke and flame to accelerate upward as they travel along and follow the shape. This accelerated movement causes great adhesion of the smoke and flame to the surface of the back wall, thus promoting the transfer of heat energy to the brick and then, by radiation, into the room. The accelerated movement of the smoke and flame with good contact to the back wall also creates a syphon pressure that establishes a current that assists air entering the bottom cassette manifold to flow through the ducts. When vented into the firebox through the openings/vents, this convective air movement provides over-fire combustion air that intensifies the fire and reduces particulate emissions. It also helps reduce conductive heat loss to the sub-hearth below the unit, thus allowing for reduces clearances to combustibles.

In some embodiments the structure uses a fabricated channel pipe tube and clip fastening system to hold, align, and properly space the individual bricks. The frame may use a series of vertical struts to form the shape of the air channel that manifolds the air up the backside of the back wall of the firebox.

Figure 2:
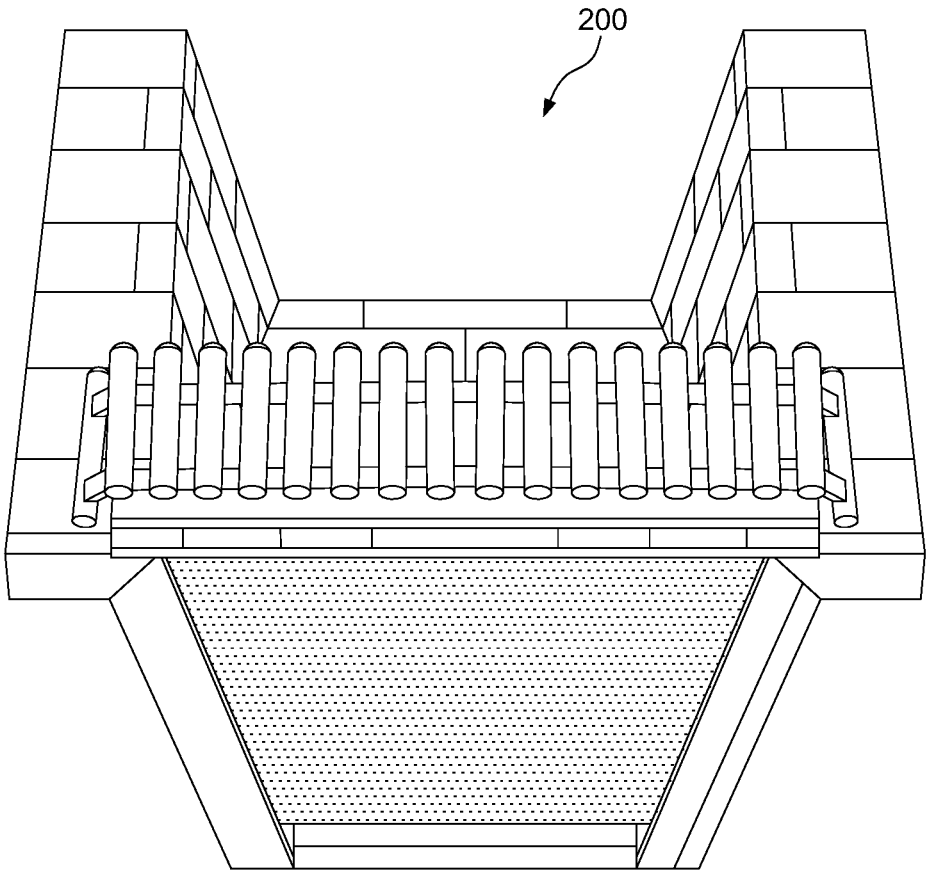
FIG. 2 is different perspective view of one embodiment of the present invention, particularly showing the lower portions of the fireplace.
Figure 3:
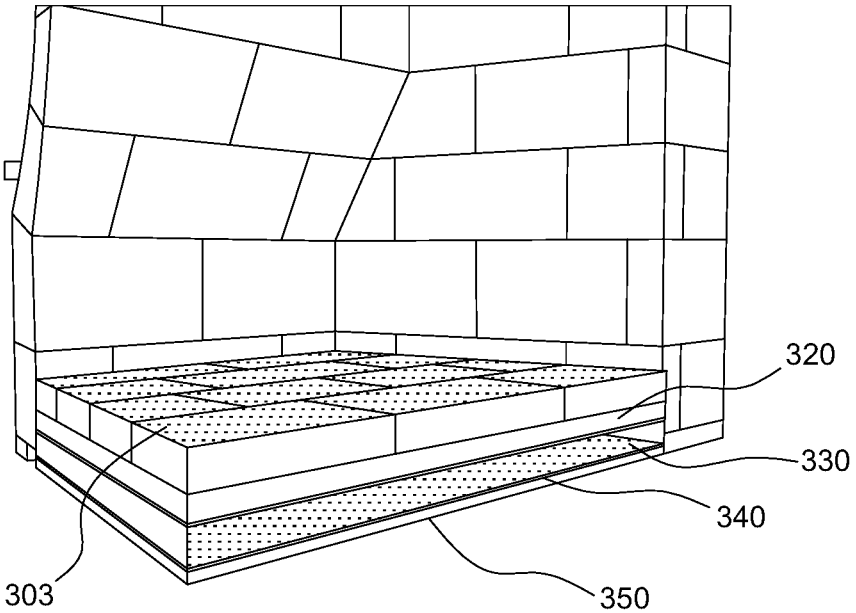
FIG. 3 is perspective view of certain portions of one embodiment of the present invention, particularly showing certain bottom manifold cassette details.

As shown in FIGS. 2 and 3, the bottom of the illustrated fireplace unit features a highly insulated air inlet manifold base. The manifold base uses air movement, reflective materials, and multiple layers of ceramic paper insulation to provide an extremely low conductive heat loss through the bottom of the unit into the masonry hearth floor of the existing masonry fireplace. In particular, the illustrated fireplace restoration retrofit system 200 includes firebox hearth floor 303, ceramic paper insulation 320, manifold air inlet 330, steel base 340, and ceramic paper insulation 350 below the base.

Figure 4A:
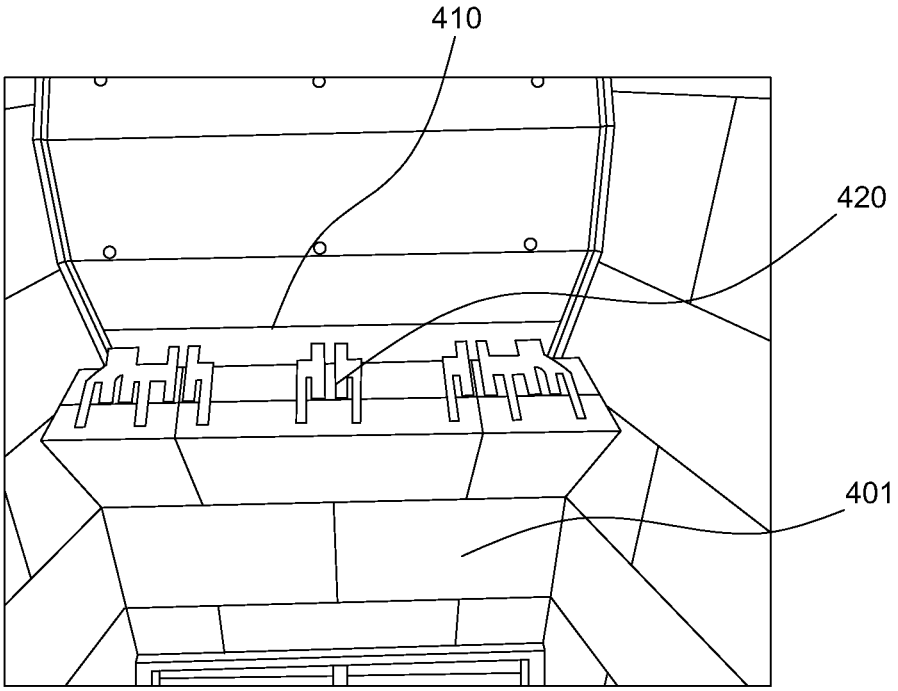
FIGS. 4A and 4B show perspective views of certain portions of one embodiment of the present invention, particularly showing certain details of the rear air plenum.
Figure 4B:
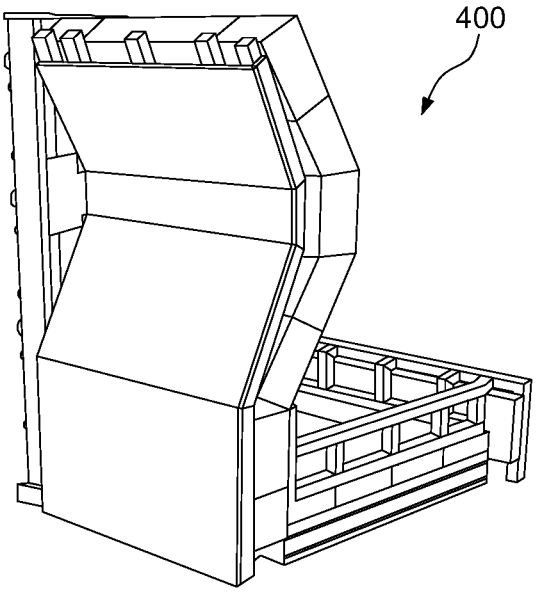

As shown in FIGS. 4A and 4B, the backside of the illustrated fireplace unit features a vertical air plenum channel that connects to the base air manifold cassette. The rear of the vertical air plenum is insulated with ceramic paper to help retard convective heat loss out the back of the unit. This helps reduce the clearance requirements at the rear of the existing masonry fireplace structure. In particular, the illustrated fireplace restoration retrofit system 400 includes rear vertical air plenum air channel 410, back wall brick clip assembly 420. And back wall brick 401.

Figure 5:
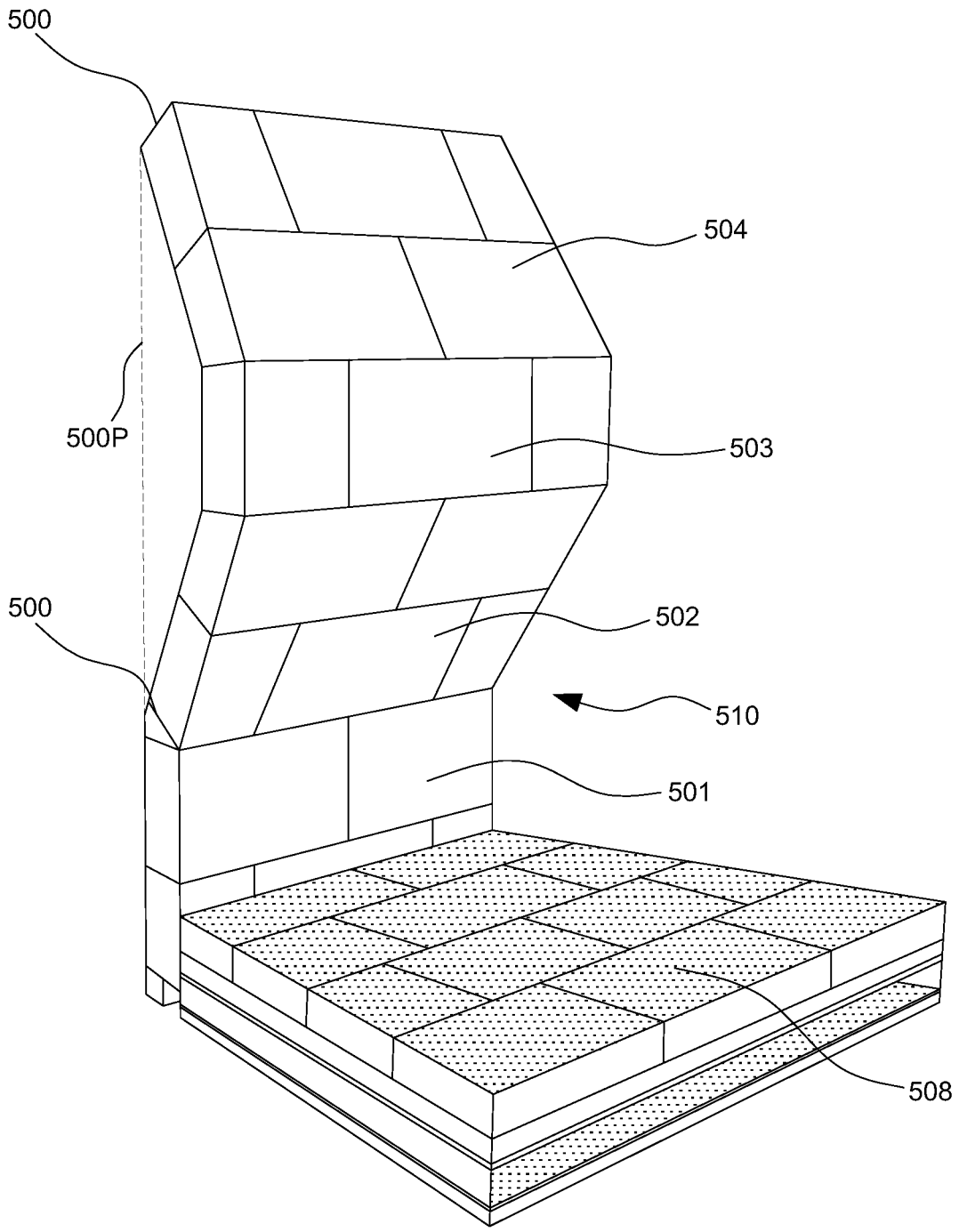
FIG. 5 is perspective view of certain portions of one embodiment of the present invention, particularly showing certain details of the firebox back wall.

As shown more clearly in FIG. 5, the inventive fireplace structure features a uniquely shaped back wall. In the illustrated embodiment the back wall rises plumb up from the hearth floor to a height of 4-8 inches (most preferably about 5⅝ inches). It then slopes forward (preferably for two courses) to a total projection of 4-8 inches (most preferably about 4 7/16 inches). From that point, the back wall rises plumb again (preferably for one course) creating a flat apex of 4-8 inches (preferably about 4½ inches). The back wall then slopes backward (preferably for two courses) to the reverse projection point of 4-8 inches (most preferably about 4 7/16 inches) back from the apex. In the most preferred embodiments the forward and backward slope courses are mirror images, and the left and right sides of the back wall are taper cut to match the splay angle of the two side walls. The back wall and backward sloped portions preferably terminate at the same plumb plane. In particular, the illustrated fireplace restoration retrofit system 500 includes a hearth floor 508, a lower portion 501, a lower angled portion 502, a central vertical portion 503, and upper angled portion 504. The back wall forward and backward slope terminate at the same plumb plane. The slope backward is a mirror image of the forward shape. There is a 4 ½" flat plumb apex bisecting the forward and backward slope angles. The back wall of the firebox slopes forward for two courses to a projection of 4 7/16". The back wall of the firebox rises up plumb from the hearth floor to a height of 5 5/8". The left and right sides of the back wall are taper cut to match the splay angle of the two side walls of the fireplace.

Figure 6:
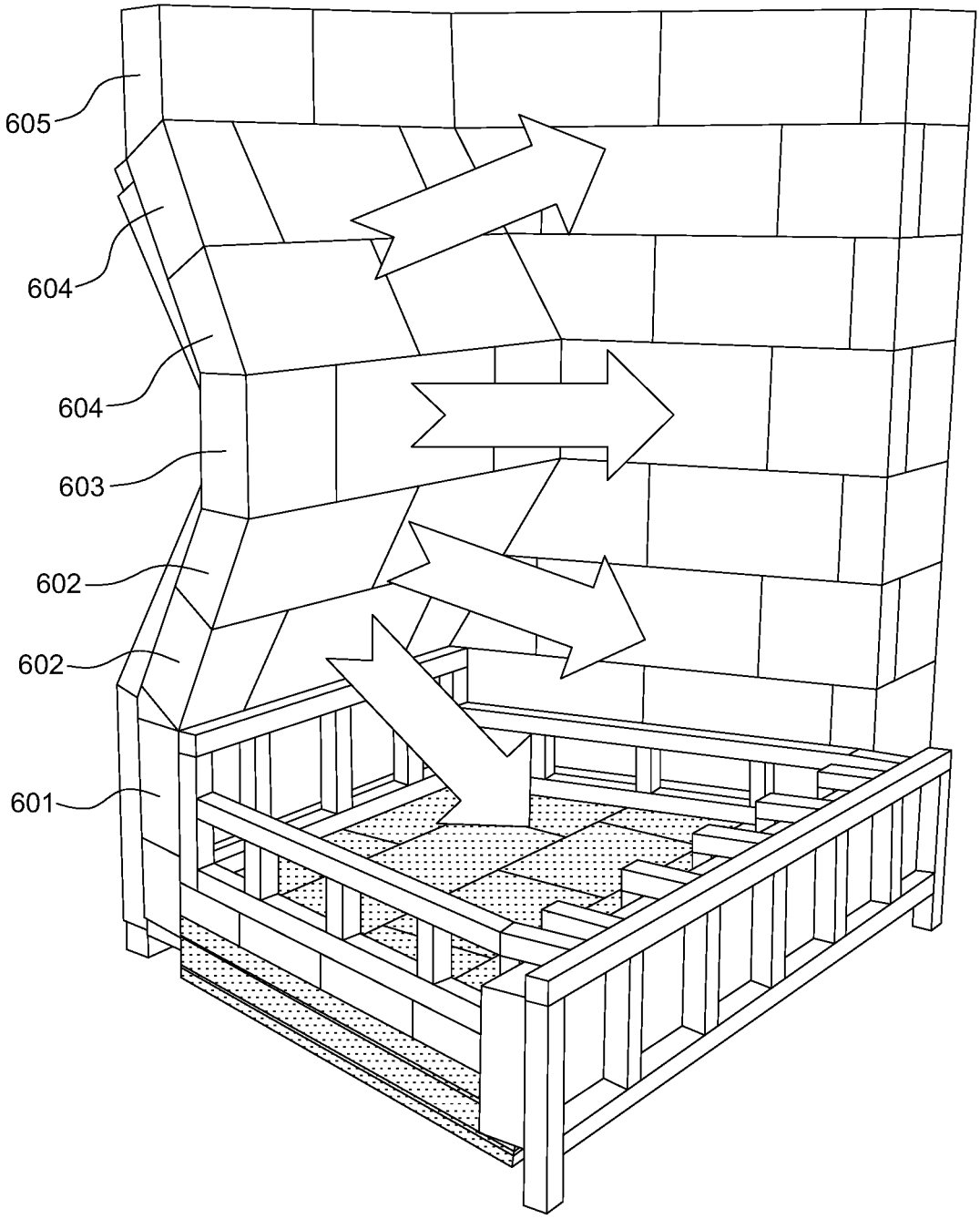
FIG. 6 is perspective view of certain portions of one embodiment of the present invention, showing additional features of the firebox back wall.

The shape of the back wall serves two distinct functions. First, by the geometry of the shape, the smoke and flame are forced to accelerate upward as they travel along and follow the shape. This accelerated movement causes great adhesion of the smoke and flame to the surfaces of the back wall. With such good contact, a tremendous amount of heat energy is transferred to the brick and then radiated into the fuel bed and out into the room. FIG. 6 shows how the uniquely shaped back wall radiates heat in specific directions. In particular, Fig. 6 shows an embodiment in which the fireplace restoration retrofit system includes a lower portion 601, a lower angled portion 602, a central vertical portion 603, and an upper angled portion 604, and an upper vertical portion 605.

Second, the accelerated movement of the smoke and flame with good contact creates a syphon pressure. This establishes a current that allows air entering the cassette manifold to flow through the passage way, and get injected into the fire through the joints between the brickwork on the back wall. This convective air movement provides over-fire combustion air that intensifies the fire and reduces particulate emissions. It also serves to help reduce conductive heat loss to the sub-hearth below the unit, and behind the back of the unit, allowing for reduced clearances to combustibles.

Figure 7A:
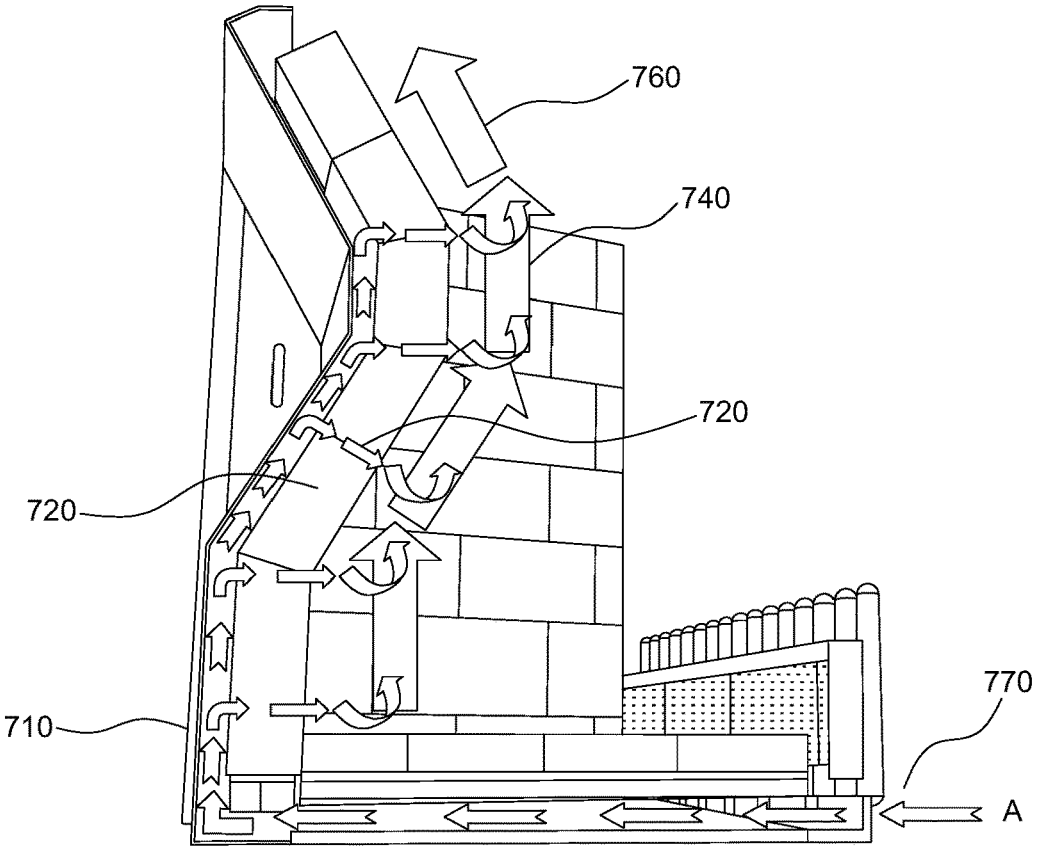
FIGS. 7A-7C show side section views of one embodiment of the present invention, showing air movement through the plenum and certain features and details of the combustion air.
Figure 7B:
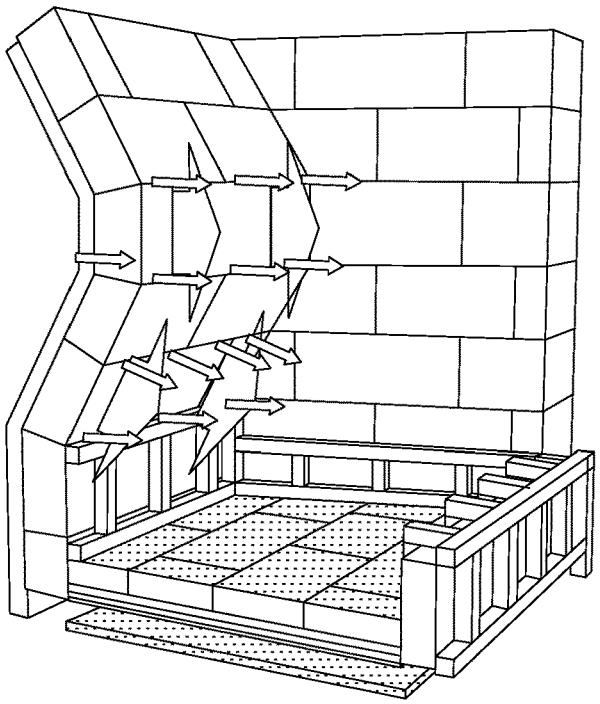
Figure 7C:
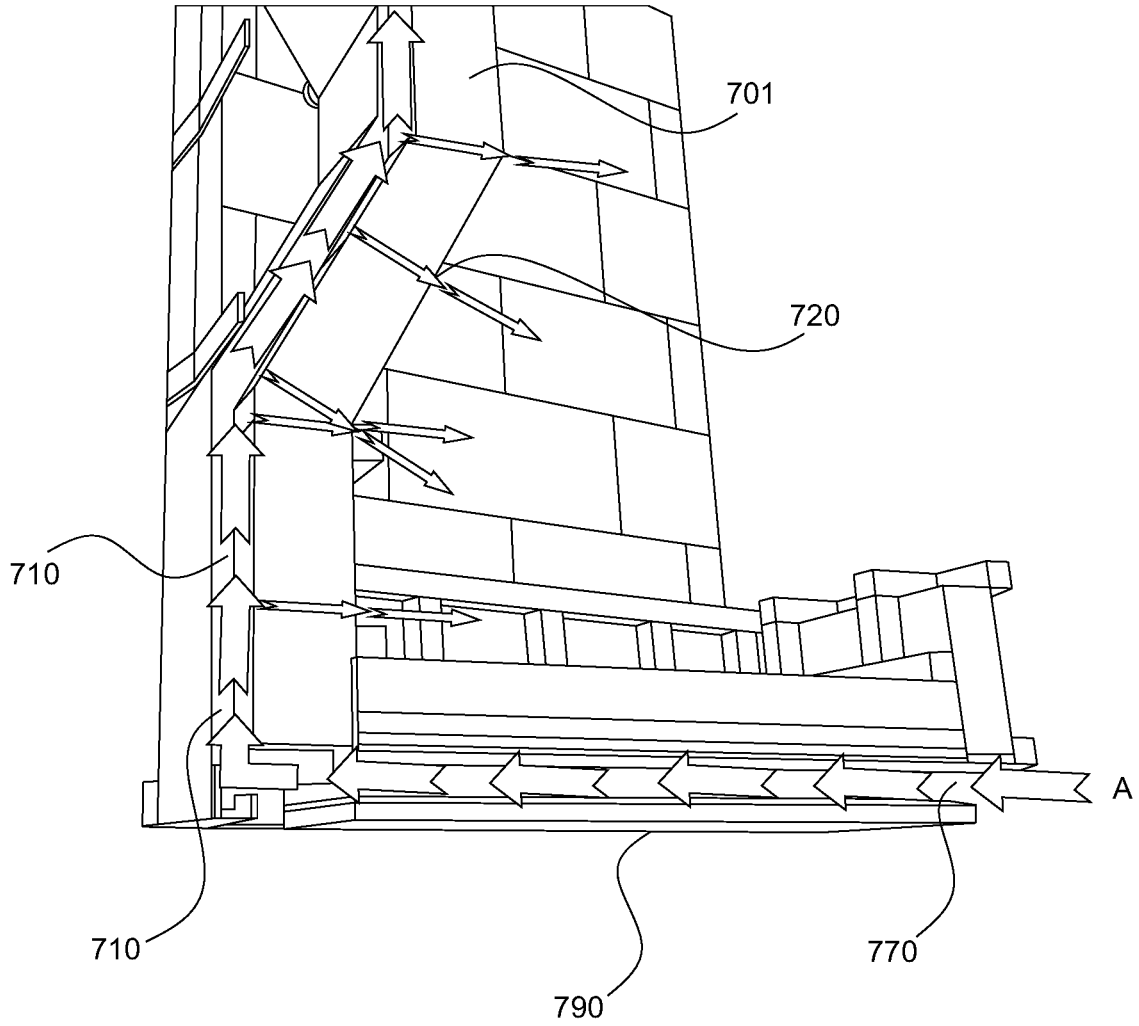

FIGS. 7A-7C show air movement through the plenum and combustion air details, according to some preferred embodiments. Air enters an air inlet manifold beneath the hearth, and passes to vertical ducts behind the rear of the firebox. Insulation on the bottom of the air inlet cassette retards heat conduction down into the floor. After traveling into and through the vertical air channels, air enters the firebox through spaces between the various sections of bricks. This pre-heated over-fire air aids combustion and provides a more efficient fireplace. The illustrated combustion air injection system cools the sub-floor and back wall of the structure while providing pre-heated air for over-fire combustion. Further, air is directed in a full spectrum pattern into the fire above the floor of the firebox to provide the best mixing of the air with the combustible gasses. In particular, the illustrated fireplace restoration retrofit system includes a lower vertical air manifold/plenum channel 710, horizontal and vertical air injection slots 720 that provide preheated over-fire air to the firebox, central vertical portion 740, and upper angled portion 760. Firebox brick wall 701 is portioned forward if the air manifold/plenum channel. Mixing of overfire air with the combustion gases occurs at central vertical portion 740 to aid combustion, and the heat and flames accelerate as they follow the shape of the brick wall over upper angled portion 760. Insulation 790 on the bottom of the air inlet cassette is designed to retain heat conduction down into the floor.

Figure 8:
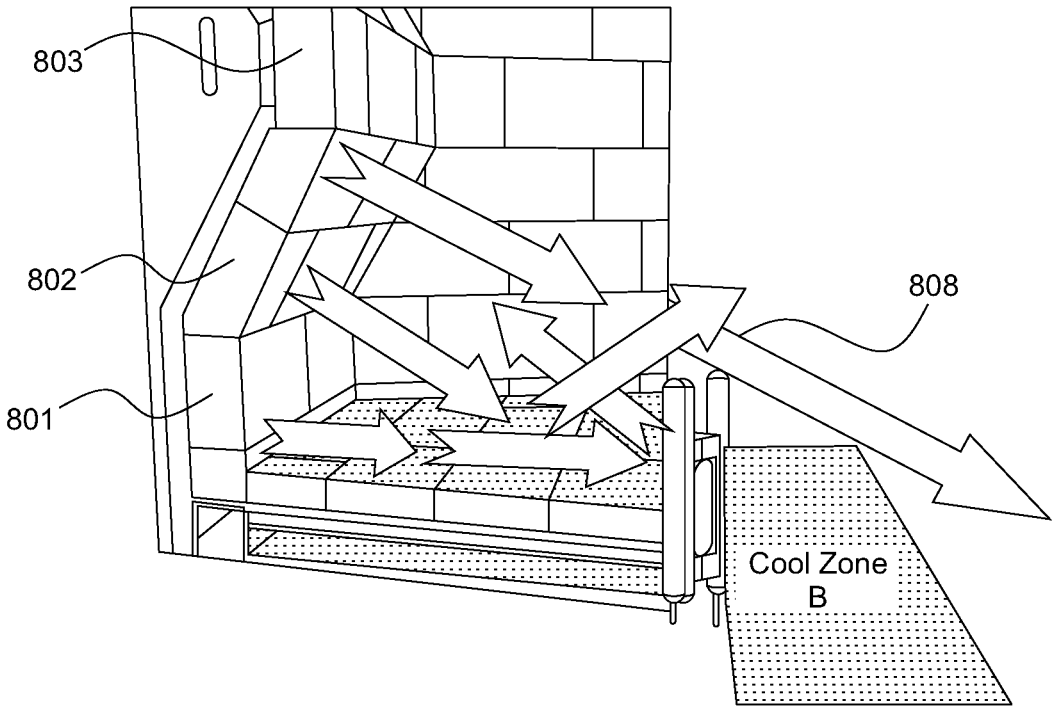
FIG. 8 is side section view of one embodiment of the present invention, showing heat radiation patters provided by the fireplace.

FIG. 8 shows how the use of low conductivity, highly reflective and insulative brick minimizes heat loss. The front radiation deflector panel provides a hearth extension that extends outward from the bottom of the fireplace opening. This is an area of concern with many fireplaces, and too often, combustible framing or form material is improperly located beneath it. The radiation and conduction of heat from a standard fireplace can place these buried combustibles in danger. In particular, the illustrated fireplace restoration retrofit system includes a lower vertical portion 801, a lower angled portion 802, and a central vertical portion 803. A cool space B will be provided in front of a radiation deflector panel. Low conductivity, highly reflective and insulative brick may be used to minimize heat loss.

Further, the front radiation deflector panel used in some embodiments of the present invention is constructed with low conductivity material that acts as a barrier and reflector. This serves to block the radiation to a broad area of the hearth extension directly in front of the fireplace creating a substantial cool zone.

Figure 9:
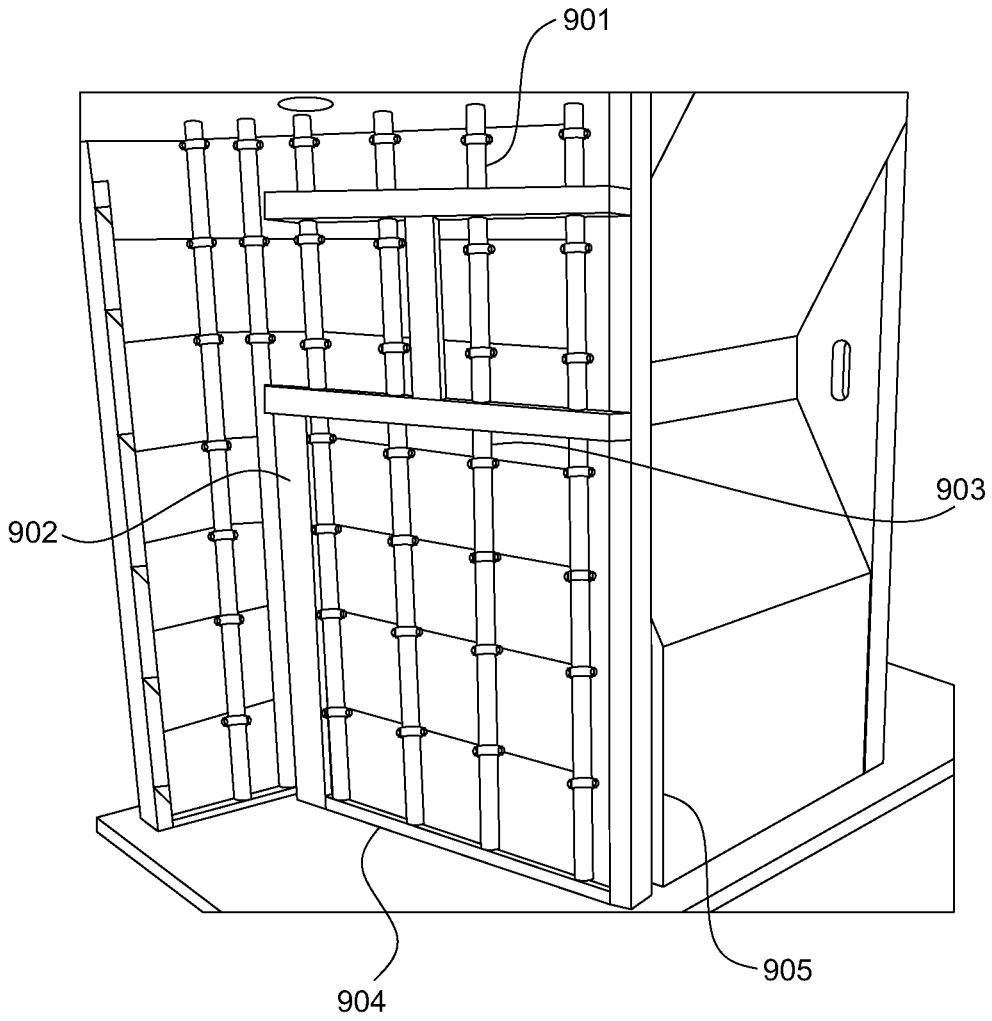
FIG. 9 is perspective view of one embodiment of the present invention, showing one embodiment of a side wall fastening system.
Figure 10A:
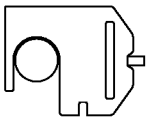
Figure 10B:
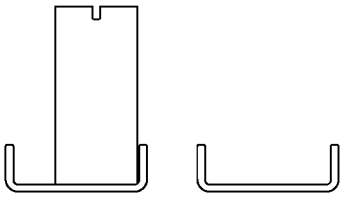
Figure 10C:
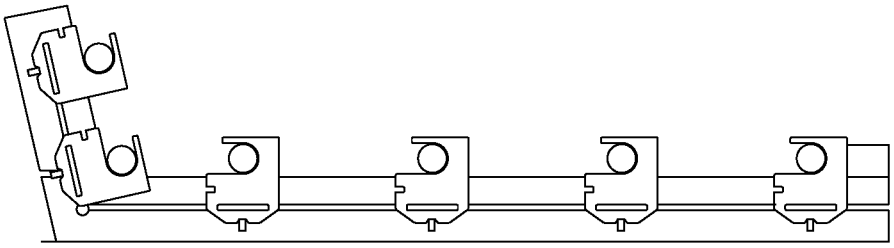
Figure 10D:
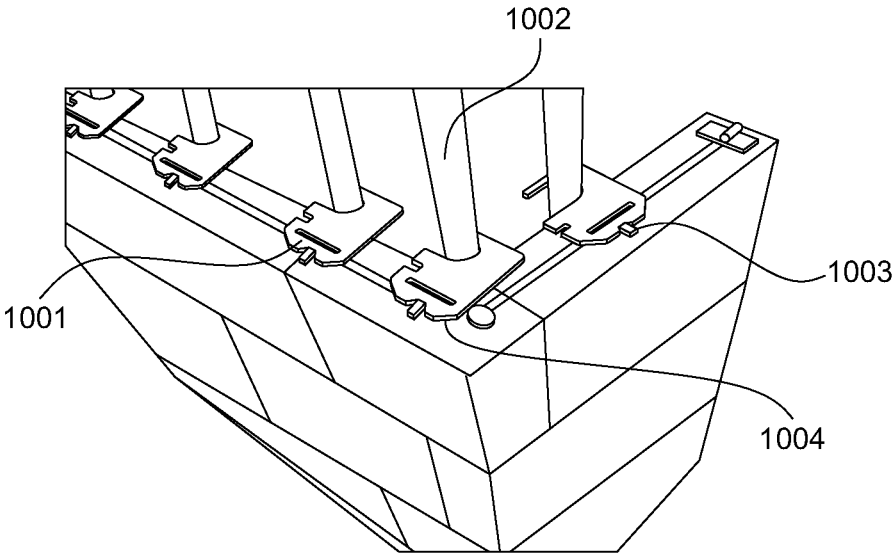
Figure 11A:
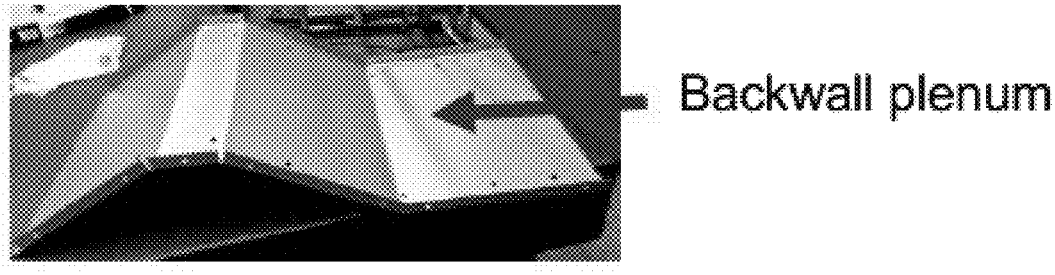
Figure 11B:
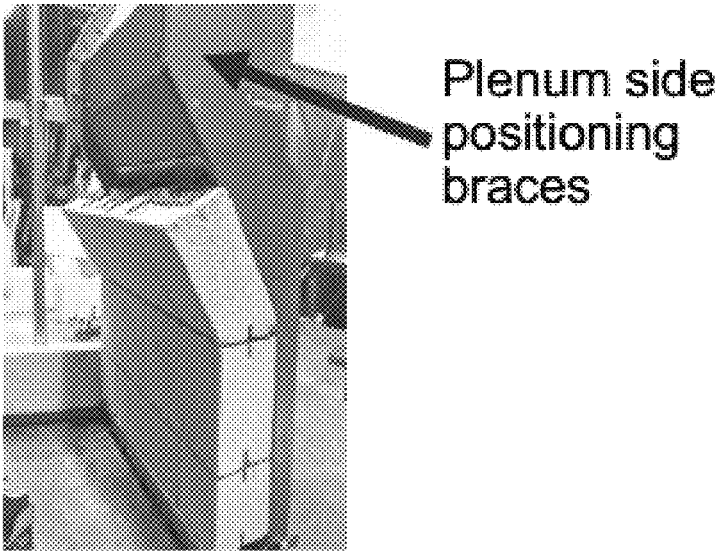
Figure 11C:
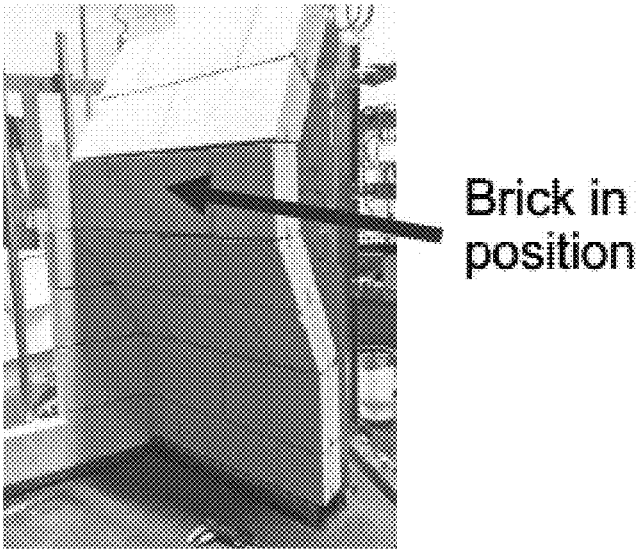
Figure 12:
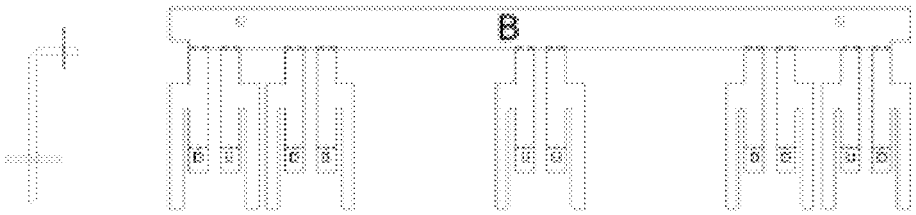
Figure 13:
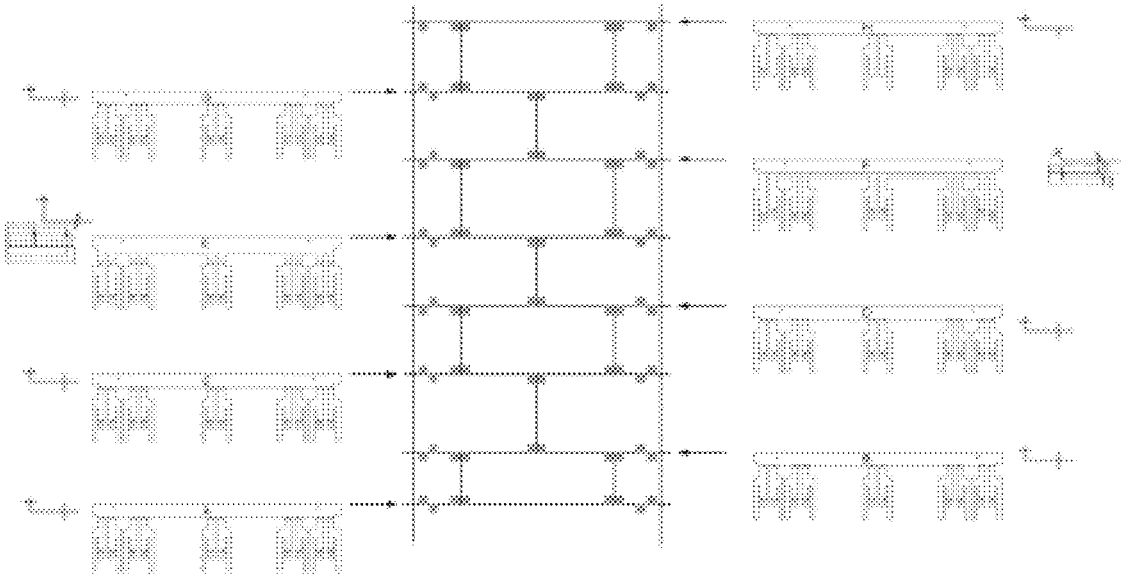
Figure 14:
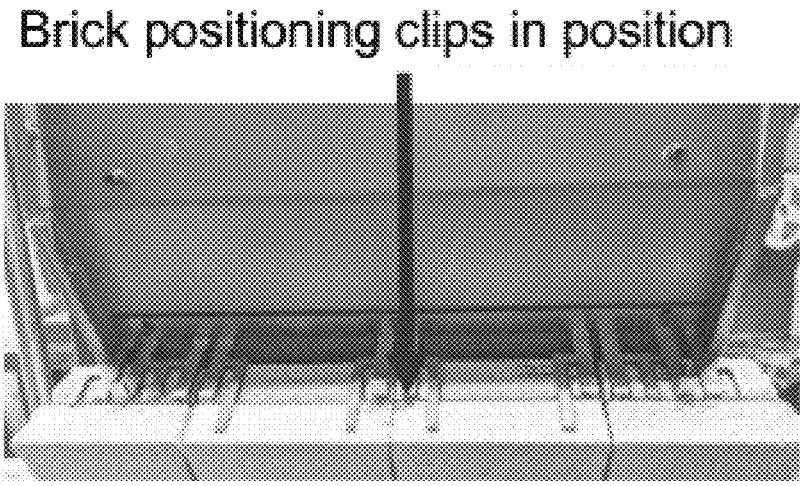

FIGS. 9 and 10A-10F show one embodiment of the fireplace brick spacing and fastening system used in the most preferred embodiments of the present invention. In the illustrated embodiment, the bricks on the back wall are set with special clip fastening system that allows construction with no mortar in the brick joints. This air space between the brick allows the heated combustion air to enter into the firebox through both the horizontal and vertical joints. The special clip fastening system allows the heated combustion air to enter into the firebox through both the horizontal and vertical joints. In particular, FIG. 9 shows an embodiment of the fireplace restoration retrofit system that includes vertical clip attachment pipes 901, side frame stays 902, attachment clips 903, bottom channel 904, and back vertical channel 905. FIG. 10 shows portions of an embodiment of the fireplace restoration retrofit system that includes brick positioning clips 1001, vertical clip attachment pipes 1002, clip drop pin 1003, and corner clips 1004.

Most preferably, the fireplace brick spacing and fastening system uses a fabricated channel pipe tube and clip fastening system incorporated into the fireplace design. On the two sidewalls, there are a bottom and back channel with vertical pipe and side stays to hold the frame fast. The clip system keeps the individual brick aligned and spaced properly both vertically and horizontally. The brick bed and head joints are mortared into place between the clip fasteners with a special refractory mortar. This fastening system assures an accurate assembly by the installer, and removes the need for specialized masonry skills.

FIGS. 11-15 show embodiments of the fireplace brick spacing and fastening system for the back wall. The back wall fastening system varies somewhat in design from the sidewall clip system because, with the shape of the back wall sloping forward, rising plumb, and then sloping back. With the preferred spacing and fastening system, the individual bricks are held in their proper position, without the aid of mortar. However, mortar is typically used between adjacent side wall bricks to achieve a more finished look.

In the illustrated embodiment there is a metal air plenum with side stiffeners that mirror the shape of the firebox back wall profile. The plenum not only forms the shape of back wall, it also channels the combustion air up behind the back wall. The brick positioning clips attach to the air plenum housing. Unlike the side walls, there is no mortar in the bed and head joints of the brickwork. The space created between the clips forms the orifice that allows the combustion air to syphon into the firebox to aid the combustion, and cool the base of the floor cassette. This fastening system assures an accurate assembly by the installer, and removes the need for specialized masonry skills.

In one embodiment the invention provides a firebox retrofit system comprising:

a) a fireplace appropriate for installing a firebox retrofit kit therein, the fireplace comprising a chimney, a flue, a lined rear wall, a pair of lined sidewalls, and a lined floor;

b) an assembled retrofit firebox assembly comprising:

i) an assembled retrofit firebox assembly frame, wherein the retrofit firebox assembly frame comprises:

a) a first sidewall frame assembly comprising a plurality of vertically extending tube members, with the tube members being spaced apart;

b) a first sidewall frame assembly comprising a plurality of vertically extending tube members, with the tube members being spaced apart;

c) a back wall metal plenum member comprising a metal sheet having a lower vertical portion, a lower angled portion extending forward into the firebox, a central vertical portion positioned forward of the plane of the lower vertical portion, an upper angled portion extending rearward from the plane of the central vertical portion, and an upper vertical portion positioned rearward of the plane of the central vertical portion, wherein the lower central angled portion, the central vertical portion, and the upper central angled portion combine to form a smooth, symmetrical bulge in the back wall extending into the firebox;

ii) a floor comprising solid masonry units;

iii) a first sidewall comprising a plurality of solid masonry units positioned on the first sidewall frame;

iv) a second sidewall comprising a plurality of solid masonry units positioned on the second sidewall frame;

v) a back wall comprising a plurality of solid masonry units positioned adjacent the back wall metal plenum member, but spaced apart from the back wall frame member to provide a back wall plenum effective to pass air behind the back wall solid masonry units; and vi) an air duct (alternatively referred to as an airflow cassette or a bottom airflow cassette) adapted to receive air from the room in front of and below the firebox, and to pass that air rearward to the space between the back wall frame member and the solid masonry units positioned thereon (alternatively referred to as the back wall plenum).

Most preferably, the solid masonry units are positioned on their respective frame members using clips that position, align, and support the solid masonry units. Clips that position, align, and support the solid masonry units may maintain a gap of between ⅛" and ½" between adjacent solid masonry units on a wall, and most preferably between adjacent solid masonry units on the back wall. The clips may maintain a gap of between ⅛" and ½" between adjacent solid masonry units of a single course, and/or between adjacent solid masonry units of adjacent courses. Clips that position, align, and support the solid masonry units on a side wall may or may not maintain a gap of between ⅛" and ½" between adjacent solid masonry units on that wall.

Similarly, clips that position, align, and support the solid masonry units with respect to the back wall may maintain a gap of between 0.5" and 2", and more preferably between 0.5" and 1", between the solid masonry units and the frame, thus providing a plenum approximately 0.75" deep for air to flow between the solid masonry units and the back frame wall.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, it is to be appreciated that the present invention may comprise or consist essentially of any or all of the illustrated or described elements. Additionally, any or all of the features, elements, and/or embodiments disclosed herein may be combined with any or all of the other features, elements, and/or embodiments disclosed herein to provide a system or method that comprises or consists essentially of such features, elements, and/or embodiments.

The phrase A "and/or" B is used in this disclosure to mean A alone, or B alone, or both A and B.

The invention claimed is:

1. A fireplace construction comprising a firebox, the firebox comprising:

a) a solid floor;

b) side walls extending upward from the floor to a flue;

c) a rear wall having:

i) a lower vertical portion, ii) a lower angled portion extending forward into the firebox and spaced slightly apart from the lower vertical portion to provide a space for air to flow into the firebox between the lower vertical portion and the lower angled portion, iii) a central vertical portion positioned forward of the plane of the lower vertical portion and spaced slightly apart from the lower angled portion to provide a space for air to flow into the firebox between the lower angled portion and the central vertical portion, iv) an upper angled portion extending rearward from the plane of the central vertical portion, and spaced slightly apart from the central vertical portion to provide a space for air to flow into the firebox between the central vertical portion and upper angled portion, and v) an upper vertical portion positioned rearward of the plane of the central vertical portion, and optionally spaced slightly apart from the upper central angled portion to optionally provide a space for air to flow into the firebox between the upper vertical portion and upper angled portion, wherein the lower central angled portion, the central vertical portion, and the upper central angled portion combine to form a smooth, symmetrical bulge in the back wall extending into the firebox;

d) one or more air ducts effective to route air from the room to the space between the lower vertical portion and the lower angled portion, and from the room to the space between the lower angled portion and the central vertical portion;

d) an open front; and e) an open top effective for directing air and combustion gasses from the firebox to a flue.

2. A fireplace construction according to claim 1, wherein the lower angled portion comprises a first lower angled portion and a second lower angled portion spaced slightly apart from the first lower angled portion to provide a space for air to flow into the firebox between the first lower angled portion and the second lower angled portion, and wherein the central vertical portion comprises a first central vertical portion and a second central vertical portion spaced slightly apart from the first central vertical portion to provide a space for air to flow into the firebox between the first central vertical portion and the second central vertical portion, and wherein the fireplace construction includes one or more air ducts effective to route air from the room to the space between the first lower angled portion and the second lower angled portion, and wherein the fireplace construction includes one or more air ducts effective to route air from the room to the space between the first central vertical portion and the second central vertical portion.

3. A fireplace construction according to claim 2, wherein the upper angled portion comprises a first upper angled portion and a second upper angled portion spaced slightly apart from the first upper angled portion to provide a space for air to flow into the firebox between the first upper angled portion and the second upper angled portion, and wherein the fireplace construction includes one or more air ducts effective to route air from the room to the space between the first upper angled portion and the second upper angled portion.

4. A fireplace construction according to claim 2, wherein the lower angled portion additionally comprises a third lower angled portion spaced slightly apart from the second lower angled portion to provide a space for air to flow into the firebox between the second lower angled portion and the third lower angled portion, and wherein the central vertical portion comprises a third central vertical portion spaced slightly apart from the second central vertical portion to provide a space for air to flow into the firebox between the second central vertical portion and the third central vertical portion, and wherein the fireplace construction includes one or more air ducts effective to route air from the room to the space between the second lower angled portion and the third lower angled portion, and wherein the fireplace construction includes one or more air ducts effective to route air from the room to the space between the second central vertical portion and the third central vertical portion.

5. A fireplace construction according to claim 4, wherein the upper angled portion comprises a third upper angled portion spaced slightly apart from the second upper angled portion to provide a space for air to flow into the firebox between the third upper angled portion and the second upper angled portion, and wherein the fireplace construction includes one or more air ducts effective to route air from the room to the space between the third upper angled portion and the second upper angled portion.

6. A fireplace construction according to claim 1, wherein the construction further includes one or more air ducts effective to route air from the room to the space between the central vertical portion and the upper angled portion.

7. A fireplace construction according to claim 1, wherein the rear wall comprises a plurality of solid masonry units supported by a frame.

8. A fireplace construction according to claim 7 wherein each of the plurality of solid masonry units is positioned on the frame using clips.

9. A fireplace construction according to claim 1, wherein the one or more air ducts provided to route air from the room to the space between the lower vertical portion and the lower angled portion, and from the room to the space between the lower angled portion and the central vertical portion, includes a manifold effective to receive air from an opening below and forward of the firebox floor and to route air entering that manifold to the space between the lower vertical portion and the lower angled portion of the rear wall, and to the space between the lower angled portion and the central vertical portion of the rear wall.

10. A fireplace construction according to claim 1, wherein the lower vertical portion, the lower angled portion, the central vertical portion, the upper angled portion, and the upper vertical portion of the rear wall each comprise one or more courses of solid masonry units.

11. A fireplace construction according to claim 10, wherein:

a) the solid masonry units of the lowermost course of the lower angled portion are spaced slightly apart from the solid masonry units of the uppermost course of the lower vertical portion to provide a space for air to flow into the firebox between the lower vertical portion and the lower angled portion; and b) the solid masonry units of the lowermost course of the central vertical portion are spaced slightly apart from the solid masonry units of the uppermost course of the lower angled portion to provide a space for air to flow into the firebox between the central vertical portion and the lower angled portion; and c) the solid masonry units of the lowermost course of the upper angled portion are spaced slightly apart from the solid masonry units of the uppermost course of the central vertical portion to provide a space for air to flow into the firebox between the upper angled portion and the central vertical portion.

12. A fireplace construction according to claim 10, wherein:

a) each of the solid masonry units of the uppermost course of the lower vertical portion is spaced slightly apart from the other solid masonry units of that course to provide a space for air to flow into the firebox between the solid masonry units of the uppermost course of the lower vertical portion;

b) each of the solid masonry units of a course of the lower angled portion is spaced slightly apart from the other solid masonry units of that course to provide a space for air to flow into the firebox between the solid masonry units of the lower angled portion; and c) each of the solid masonry units of a course of the central vertical portion is spaced slightly apart from the other solid masonry units of that course to provide a space for air to flow into the firebox between the solid masonry units of the central vertical portion.

* * * * *